United States Patent [19]

Svensson

[11] Patent Number: 5,058,738

[45] Date of Patent: Oct. 22, 1991

[54] PACKAGE FOR A CLEANING ARTICLE SUCH AS A MOP

[75] Inventor: Leif R. Svensson, Viskafors, Sweden

[73] Assignee: Aktiebolaget Electrolux, Stockholm, Sweden

[21] Appl. No.: 472,610

[22] Filed: Jan. 30, 1990

[30] Foreign Application Priority Data

Feb. 7, 1989 [SE] Sweden ..... 8900406

[51] Int. Cl.[5] ..... B65D 85/00

[52] U.S. Cl. ..... 206/229; 206/209

[58] Field of Search ..... 206/204, 205, 207, 209, 206/229, 361, 362, 812

[56] References Cited

U.S. PATENT DOCUMENTS

| | | | |
|---|---|---|---|
| 3,038,473 | 6/1962 | Ladd | 206/222 |
| 3,419,134 | 12/1968 | Fitts . | |
| 3,534,887 | 10/1970 | Ginsberg | 206/229 |
| 3,573,069 | 3/1971 | Keller et al. . | |
| 3,635,567 | 1/1972 | Richardson, Jr. | 206/229 |
| 3,720,305 | 3/1973 | Barton | 206/219 |
| 3,889,804 | 6/1975 | Ravich | 206/222 |
| 3,952,867 | 4/1976 | McCord | 206/229 |
| 4,197,947 | 4/1980 | Zaidi | 206/807 |
| 4,226,330 | 10/1980 | Butler | 206/219 |
| 4,696,393 | 9/1987 | Laipply | 206/812 |
| 4,776,455 | 10/1988 | Anderson et al. | 206/0.5 |
| 4,844,251 | 7/1989 | Gueret | 206/229 |
| 4,856,651 | 8/1989 | Francis, Jr. | 206/219 |

FOREIGN PATENT DOCUMENTS

| | | | |
|---|---|---|---|
| 2436504 | 4/1975 | Fed. Rep. of Germany | 206/205 |

*Primary Examiner*—Jimmy G. Foster

*Attorney, Agent, or Firm*—Pearne, Gordon, McCoy & Granger

[57] ABSTRACT

A package for a cleaning mop or the like where the mop (12) is delivered packed in a hermetically-sealed cover (10). Said cover also surrounds a receptacle (14) for a liquid, the receptacle being breakable so that the liquid flows out into the cover and thereby impregnates the mop.

10 Claims, 1 Drawing Sheet

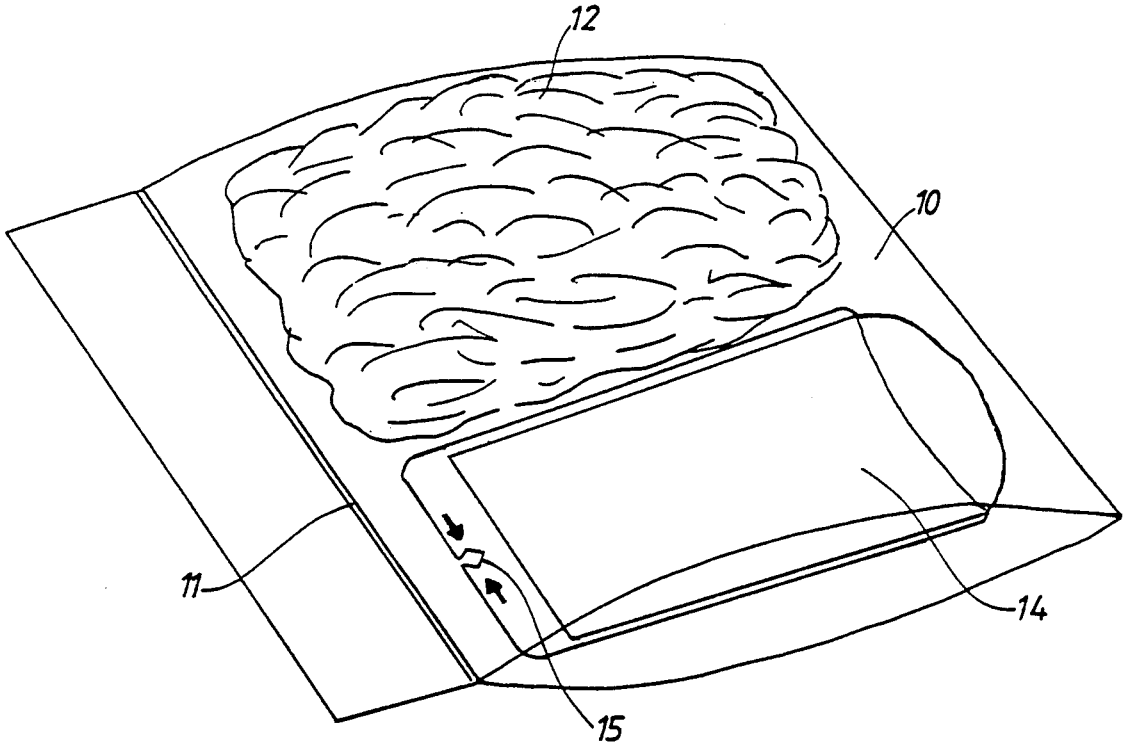
12
10
11
14
15

PACKAGE FOR A CLEANING ARTICLE SUCH AS A MOP

BACKGROUND OF THE INVENTION

The present invention relates in general to mops and cleaning articles, and in particular to a package for the delivery of a mop and a cleaning liquid.

PRIOR ART

With regard to mops used for cleaning purposes, it is known in the prior art to use mops which are delivered impregnated with a cleaning liquid. These mops are surrounded by a plastic bag, which prevents the liquid from evaporating and makes it possible to transport and store the mop in a convenient way. However, these packages have certain drawbacks. After a comparatively short time, a large bacteriologic growth can occur in the impregnated mop. When the mop is used later, there will be an annoying odor and an unhygienic condition. As a result, such mops must be handled as perishables.

It is also known in the prior art to use cleaning articles comprising a foam applicator pad, which is combined with a receptacle for fluid into one single unit. These articles are used for skin preparation or pre-operation purpose (see WO 81/00196). The receptacle encloses a liquid disinfectant cleaning agent or some other type of suitable liquid and is made of a material which is ruptured when the article is used. By deforming the receptacle, the liquid is pressed out into the pad and the pad is thrown away after it has been used. A drawback with this type of article is that it cannot be reused, since the receptacle, which is a part of the article, is broken.

SUMMARY OF THE INVENTION

In accordance with the present invention, a package for a cleaning article is disclosed. The package comprises a hermetically-sealed cover, which cover surrounds the cleaning article and a liquid consisting of a cleaning agent, which liquid is enclosed in a hermetically-sealed receptacle so that the liquid is separated from the cleaning article. The cleaning agent can be used for cleaning and/or disinfecting purposes. The receptacle is provided with means by which the receptacle can be opened without rupturing the cover so that the liquid flows out into the cover and impregnates the cleaning article.

The purpose of the present invention is to eliminate the drawbacks mentioned above and to create a mop which can be stored for a long time and which can easily be impregnated with liquid shortly before it is to be used. The mop can be saved and returned to a laundry, where it is washed and packaged for reuse.

A preferred embodiment of the present invention is described in the following specification with reference to the accompanying drawing.

BRIEF DESCRIPTION OF THE DRAWING

FIG. 1 is a perspective view of a package for a mop of the present invention.

DESCRIPTION OF THE PREFERRED EMBODIMENT

In FIG. 1 a hermetically-sealed cover 10, preferably made of transparent plastic sheeting, is shown. The cover has a tear-off edge 11 by means of which the cover 10 can be opened. The cover 10 surrounds a dry mop 12, which in a conventional way, is to be applied on a mop frame with a handle for cleaning a floor surface. The cover 10 also surrounds a hermetically-sealed receptacle 14, which receptacle contains a cleaning and/or a disinfecting agent. The receptacle 14 has a tear-off edge 15 by means of which the receptacle 14 can be opened without breaking the cover 10. The receptacle 14, which is mainly rectangular, is provided with rounded corners in order not to rupture the cover 10.

When the mop is used, the receptacle 14 is opened from the outside of the cover 10 by breaking or tearing off the tear-off edge 15. This means that the liquid in the receptacle 14 flows out into the surrounding cover 10 and the mop is impregnated by the liquid. The mop can then be used by opening the cover 10 or by breaking the tear-off edge 11.

It should be observed that this invention is not limited to mops, but of course can be used for cleaning cloths of different types. Mops and cleaning cloths are referred to in the claims as a cleaning article. It is not necessary to place the receptacle separately within the cover. The cover and the receptacle could share common external plastic sheeting, and could be joined in a suitable way, i.e., by being manufactured of the same plastic sheeting with a common weld-seam, the seam being possible to open without opening the cover so that a passage from the receptacle is created when the mop is to be impregnated.

Although the preferred embodiment of this invention has been shown and described, it should be understood that various modifications, replacements, and rearrangements of the parts may be resorted to without departing from the scope of the invention as disclosed and claimed herein.

What is claimed is:

1. A package for a cleaning article, wherein said package comprises a hermetically-sealed cover (10), which cover surrounds said cleaning article (12) and a liquid consisting of a cleaning agent, which liquid is enclosed in a hermeticallysealed receptacle (14) so that said liquid is separated from said cleaning article, said receptacle (14) being provided with means by which said receptacle can be opened without rupturing said cover so that said liquid flows out into said cover (10) and impregnates said cleaning article (12), wherein said means consists of a tear-off edge (15).

2. A package according to claim 1, wherein said cover (10) consists of a transparent material.

3. A package according to claim 2, wherein said receptacle (14) is a separate part which is placed within said cover (10).

4. A package according to claim 1, wherein said cover (10) consists of plastic sheeting.

5. A package according to claim 4, wherein said cover (10) has a tear-off edge (11).

6. A package according to claim 1, wherein said receptacle (14) is a separate part which is placed within said cover (10).

7. A package according to claim 6, wherein said cover (10) has a tear-off edge (11).

8. A package according to claim 1, wherein said cover (10) has a tear-off edge (11).

9. A package according to any one of claims 1, 2, 3, 4, 5, 6, 7, or 8, wherein said receptacle (14) is mainly rectangular and has rounded corners.

10. A package according to claim 1, wherein said cover consists of a transparent plastic sheeting, said receptacle (14) is mainly rectangular and has rounded corners and is a separate part which is placed within said cover (10), and said cover (10) has a tear-off edge (11).

* * * * *